US009631786B2

(12) United States Patent
Honda

(10) Patent No.: US 9,631,786 B2
(45) Date of Patent: Apr. 25, 2017

(54) VEHICLE LAMP WITH PREDETERMINED POSITIONING OF SHADE AND PROJECTION LENS FOCAL POINT

(71) Applicant: KOITO MANUFACTURING CO., LTD., Tokyo (JP)

(72) Inventor: Takahiko Honda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 28 days.

(21) Appl. No.: 14/613,676

(22) Filed: Feb. 4, 2015

(65) Prior Publication Data

US 2015/0219301 A1 Aug. 6, 2015

(30) Foreign Application Priority Data

Feb. 5, 2014 (JP) ..... 2014-020573

(51) Int. Cl.
*F21S 8/10* (2006.01)

(52) U.S. Cl.
CPC ..... *F21S 48/145* (2013.01); *F21S 48/1159* (2013.01); *F21S 48/125* (2013.01); *F21S 48/1258* (2013.01); *F21S 48/137* (2013.01); *F21S 48/1388* (2013.01); *F21S 48/1747* (2013.01)

(58) Field of Classification Search
CPC .... F21S 48/145; F21S 48/147; F21S 48/1159; F21S 48/1258
See application file for complete search history.

(56) References Cited

U.S. PATENT DOCUMENTS

| | | | | |
|---|---|---|---|---|
| 9,052,080 | B2 * | 6/2015 | Tsukamoto | F21S 48/1159 |
| 2005/0068787 | A1 | 3/2005 | Ishida | |
| 2008/0112180 | A1 * | 5/2008 | Okada | F21S 48/1154 362/518 |

FOREIGN PATENT DOCUMENTS

| | | | |
|---|---|---|---|
| CN | 101178160 | A | 5/2008 |
| CN | 102338337 | A | 2/2012 |
| EP | 1912018 | A1 | 4/2008 |
| EP | 2196727 | A1 | 6/2010 |
| JP | 2008-123753 | A | 5/2008 |

OTHER PUBLICATIONS

Office Action dated Oct. 9, 2016, issued by the State Intellectual Property Office of P.R. China in counterpart Chinese Application No. 201510059641.9.

* cited by examiner

*Primary Examiner* — Karabi Guharay
(74) *Attorney, Agent, or Firm* — Sughrue Mion, PLLC

(57) ABSTRACT

A vehicle lamp 10 includes a projection lens 12 which is disposed on an optical axis which extends in a longitudinal direction of a vehicle, an LED 14 which emits light which is directed towards a rear focal point F of the projection lens, an LED 16 which emits light which is directed towards the rear focal point of the projection lens, and a shade 22 which can not only form a first light distribution pattern having a first cut-off line by cutting off part of light emitted from the LED 14 but also form a second light distribution pattern having a second cut-off line by cutting off part of light emitted from the LED 16. The shade 22 is disposed so that a front edge 22*a* thereof is positioned further rearwards than the rear focal point F.

4 Claims, 11 Drawing Sheets

VEHICLE LAMP WITH PREDETERMINED POSITIONING OF SHADE AND PROJECTION LENS FOCAL POINT

CROSS-REFERENCE TO RELATED APPLICATION

The present application claims the benefit of priority of Japanese Patent Applications No. 2014-020573, filed on Feb. 5, 2014, which is incorporated herein by reference.

TECHNICAL FIELD

The present invention relates to a vehicle lamp.

BACKGROUND ART

Conventionally, there have been devised vehicle lamps in which a plurality of light sources are disposed in a lamp unit and the light sources are controlled individually to be turned on and off so that light distribution patterns produced by the light sources can be switched between a low beam light distribution pattern and a high beam light distribution pattern.

For example, a vehicle lamp unit is devised which includes a projection lens, a reflector configured to reflect direct light from a first light source which is disposed further rearwards than a rear focal point of the projection lens to the front while directing it towards an optical axis of the projection lens, a cut-off line forming member which is disposed between the projection lens and the first light source so that a front edge thereof is positioned near the focal point of the projection lens so as to cut off part of light of the reflected light which passes below the rear focal point to thereby form a cut-off line for a low beam light distribution pattern, and an additional reflector configured to collect light from a second light source to the vicinity of the rear focal point of the projection lens (refer to Patent Document JP-A-2008-123753). In such the vehicle lamp unit, the light from the second light source is collected to the vicinity of the rear focal point of the projection lens in such a state that the front edge of the cut-off line forming member and the rear focal point of the projection lens are spaced apart relatively from each other to thereby form a high beam light distribution pattern.

SUMMARY OF THE INVENTION

In the vehicle lamp unit described above, however, the cut-off line forming member moves to a position where the light from the first light source and the light from the second light source are not cut off when forming the high beam light distribution pattern. Because of this, the light distribution pattern which is formed by the light from the first and second light sources has no cut-off line.

Additionally, in the vehicle lamp unit described above, in case the cut-off line forming member, which is provided one, is disposed in a position where both part of the light from the first light source and part of the light from the second light source are cut off (that is, a position lying near the rear focal point of the projection lens), both the light distribution patterns have a cut-off line. As this occurs, a non-illuminated area is produced between the two light distribution patterns, depending upon the shape of the cut-off line forming member.

The invention has been made in view of these situations, and an object thereof is to provide a vehicle lamp which can form a plurality of light distribution patterns by a plurality of light sources and one shade in such a way that the two light distribution patterns partially overlap.

With a view to solving the problem, according to an aspect of the invention, there is provided a vehicle lamp including a projection lens which is disposed on an optical axis which extends in a longitudinal direction of a vehicle, a first light source which emits light which is directed towards a rear focal point of the projection lens, a second light source which emits light which is directed towards the rear focal point of the projection lens, and a shade which can not only form a first light distribution pattern having a first cut-off line by cutting off part of light emitted from the first light source but also form a second light distribution pattern having a second cut-off line by cutting off part of light emitted from the second light source. The shade is disposed so that a front end portion thereof is positioned further rearwards than the rear focal point.

According to this configuration, not only the light which passes in front of the rear focal point of the projection lens but also the partial light which passes behind the rear focal point of the projection lens contributes to the formation of the first light distribution pattern and the second light distribution pattern. This enables the first light distribution pattern and the second light distribution patter to partially overlap to thereby restrict a non-illuminated area from being produced between the two light distribution patterns.

The shade may be configured to make the first cut-off line and the second cut-off line constitute a horizontal cut-off line from a center to areas lying near left and right ends thereof. This enables the light distribution patterns preferable for a motorbike, for example, to be obtained.

The shade may be disposed so that a front end portion thereof faces a focal curve of the projection lens and may be formed into a shape in which a distance between the front end portion and the focal curve in an area which lies far away from the optical axis is larger than a distance between the front end portion and the focal curve in an area which lies near the optical axis. This enables the shape of the cut-off line of the light distribution pattern formed far away from the optical axis to be changed at both end portions thereof.

The vehicle lamp may include further a first reflector configured to reflect light emitted from the first light source towards the projection lens while directing it towards the optical axis, and a second reflector which is provided on an opposite side to a side where the first reflector is provided across the optical axis and which is configured to reflect light emitted from the second light source towards the projection lens while directing it towards the optical axis. The shade may be configured not only to form a low beam light distribution pattern having a first cut-off line at an upper edge portion but also to form a high beam light distribution pattern having a second cut-off line at a lower edge portion. This enables different cut-off lines to be formed in the individual light distribution patterns.

The shade may be configured to enable areas of the first light distribution pattern and the second light distribution pattern to partially overlap. This can improve the brightness of the illuminated area where the first light distribution pattern and the second light distribution pattern overlap.

The shade may be disposed so that the front end portion is positioned further upwards than the rear focal point. This can reduce the light that forms one of the first light distribution pattern and the second light distribution pattern and increase the light that forms the other of the first light distribution pattern and the second light distribution pattern.

Arbitrary combinations of the constituent elements described above and changes in representation of the invention between method, apparatus, system and the like are also effective as forms of the invention.

According to the invention, it is possible to provide the vehicle lamp in which the two light distribution patterns partially overlap.

DESCRIPTION OF EMBODIMENTS

Figure 1:
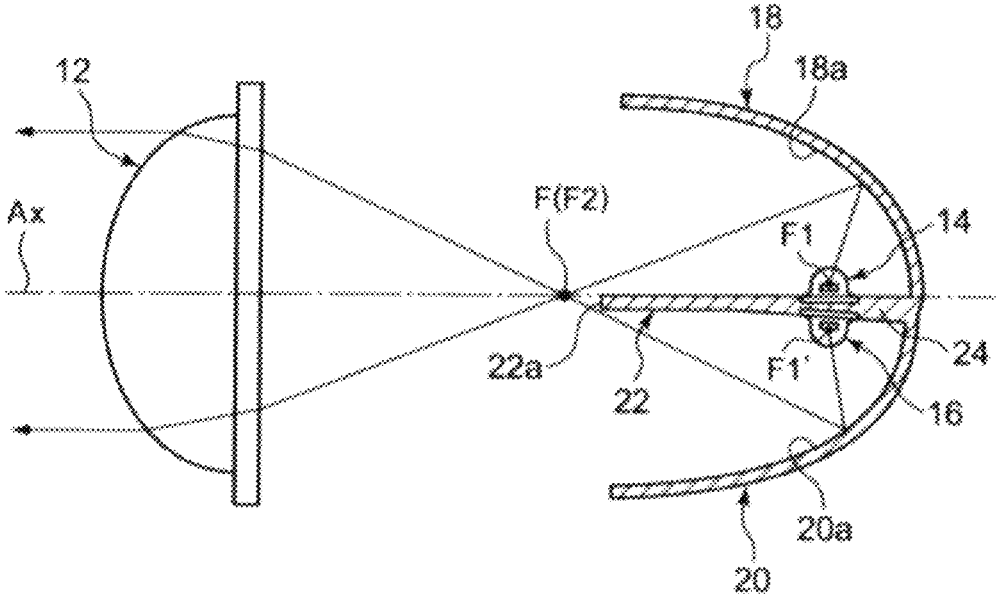
FIG. 1 is a vertical sectional view of a vehicle lamp according to a first embodiment.

Hereinafter, referring to the drawings, the invention will be described based on preferred embodiments. Like reference numerals will be given to like or similar constituent elements, members and processes that are shown in the drawings, so that the repetition of a similar description thereof will be omitted. Embodiments described herein are not intended to limit the invention but intended to show examples thereof, and all characteristics and combinations thereof that are described in the embodiments are not necessarily essential to the invention.

First Embodiment

Figure 2:
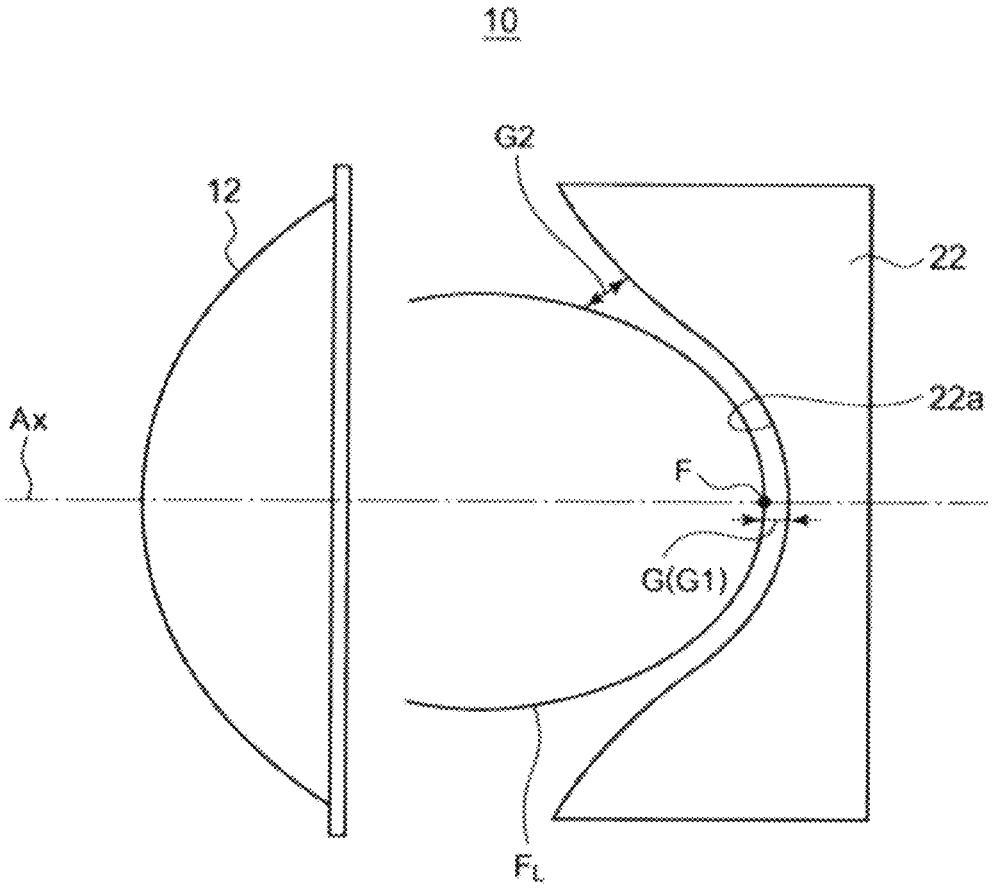
FIG. 2 is a schematic view of the vehicle lamp according to the first embodiment as seen from thereabove, illustrating the shape of a shade.
Figure 3:
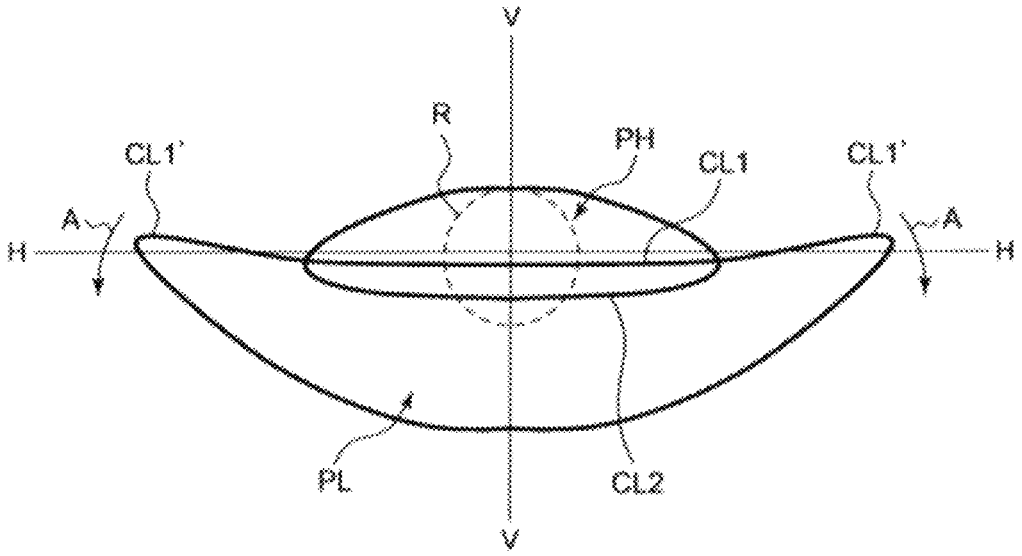
FIG. 3 is a schematic view of an example of light distribution patterns formed by the vehicle lamp according to the first embodiment.
Figure 4A:
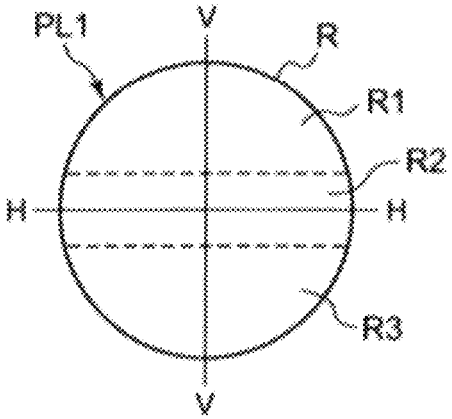
FIGS. 4(*a*) to 4(*h*) each illustrate a relationship between the position of a front end of the shade relative to a rear focal point F of a projection lens and light distribution patterns formed.
Figure 4B:
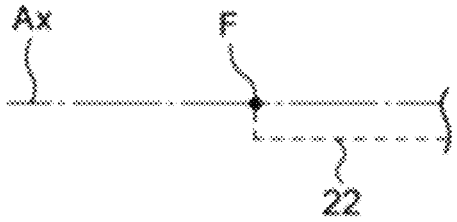
Figure 4C:
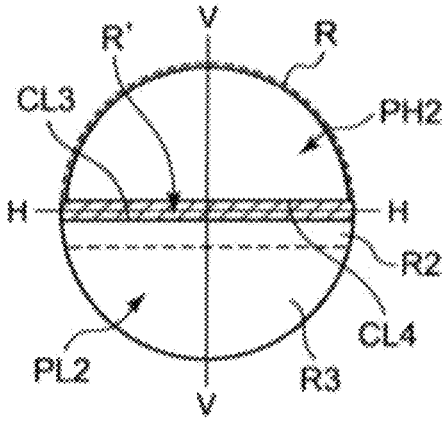
Figure 4D:
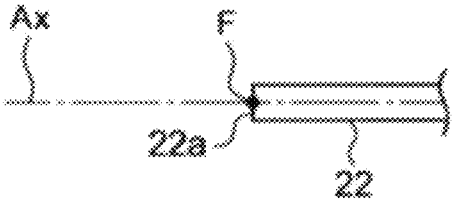
Figure 4E:
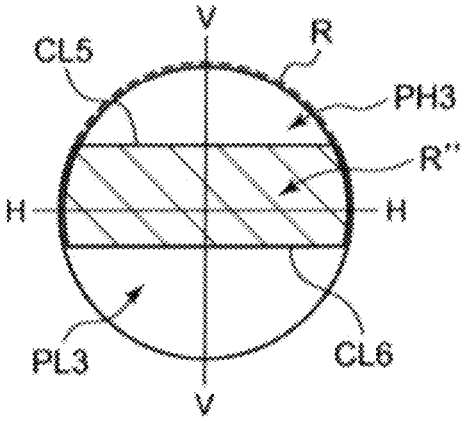
Figure 4F:
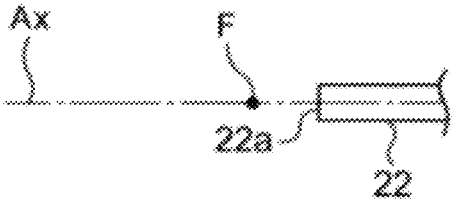
Figure 4G:
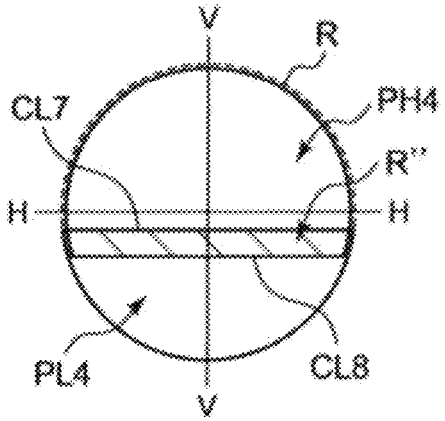
Figure 4H:
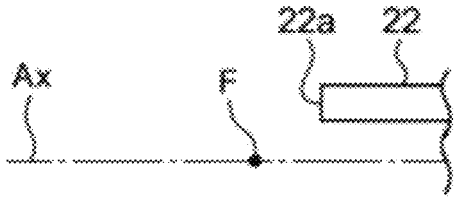

FIG. 1 is a vertical sectional view of a vehicle lamp according to a first embodiment. FIG. 2 is a schematic view of the vehicle lamp according to the first embodiment as seen from thereabove, illustrating the shape of a shade. FIG. 3 is a schematic view of an example of light distribution patterns formed by the vehicle lamp according to the first embodiment.

A vehicle lamp 10 according to a first embodiment of the invention is used as a vehicle headlamp in which light distribution patterns can be switched over. The vehicle lamp 10 includes a projection lens 12 which is disposed on an optical axis Ax which extends in a longitudinal direction of a vehicle, LEDs (light emitting diodes) 14, 16 which constitute a first light source and a second light source which are disposed to the rear of the projection lens 12, a first reflector 18 configured to reflect light emitted upwards from the LED 14 which is disposed further rearwards than a rear focal point F of the projection lens 12 towards the front while directing it towards the optical axis Ax, a second reflector 20 configured to reflect light emitted downwards from the LED 16 which is disposed further rearwards than the rear focal point F of the projection lens 12 towards the front while directing it towards the optical axis Ax, and a shade 22 which is disposed so that a front edge 22*a* is positioned in an area lying between the projection lens 12 and the LEDs 14, 16.

In general, a planoconvex lens, in which a front surface is form into a convexly curved surface and a rear surface is formed into a flat surface, is used as the projection lens 12. The projection lens 12 is disposed so that a line connecting an upper end and a lower end of a rear end face which is the flat surface facing the first reflector 18 becomes parallel to the vertical.

The LEDs 14, 16 are, for example, white light emitting diodes each having a single light emitting chip of substantially a one-millimeter square or a rectangular light emitting portion where a plurality of chips are aligned. The LEDs 14, 16 are mounted on a substrate in such a way that the LEDs 14, 16 are fixed to an upper surface and a lower surface of a base portion 24, respectively. The LED 14 emits light directed to the rear focal point F of the projection lens 12, and the LED 16 emits light directed to the rear focal point F of the projection lens 12.

The LED 14 is illuminated not only when forming a low beam light distribution pattern as a first light distribution pattern but also when forming a high beam light distribution pattern as a second light distribution pattern, while the LED 16 is illuminated when forming the high beam light distribution pattern.

The first reflector 18 has a reflecting surface 18*a* which is formed substantially ellipsoidal about the optical axis Ax as a center axis. This reflecting surface 18*a* is formed so that a sectional shape including the optical axis Ax becomes substantially elliptic. The LED 14 is disposed near a first focal point F1 of an ellipse which is formed by a vertical section of the reflecting surface 18*a* which includes the optical axis Ax. By disposing the LED 14 in that way, the reflecting surface 18*a* reflects light from the LED 14 to the front while directing it towards the optical axis Ax. As this occurs, the light is caused to converge substantially to a second focal point F2 of the ellipse within the vertical section including the optical axis Ax. In this embodiment, this second focal point F2 substantially coincides with the rear focal point F of the projection lens 12.

The second reflector 20 has a reflecting surface 20*a* which is formed substantially ellipsoidal about the optical axis Ax as a center axis. This reflecting surface 20*a* is formed so that a sectional shape including the optical axis Ax becomes substantially elliptic. The LED 16 is disposed near a first focal point F1' of an ellipse which is formed by a vertical section of the reflecting surface 20*a* which includes the optical axis Ax. By disposing the LED 16 in that way, the reflecting surface 20*a* reflects light from the LED 16 to the front while directing it towards the optical axis Ax. As this occurs, the light is caused to converge substantially to the second focal point F2 of the ellipse within the vertical section including the optical axis Ax. The shapes of the reflecting surfaces of the first reflector 18 and the second reflector 20 are selected or modified finely as required according to the shapes of light distribution patterns required and may be different from each other.

The shade 22 configured to form cut-off lines is a light cutting-off member which cuts off partially light emitted from the LED 14 and then reflected on the reflecting surface

18*a* of the first reflector 18. The front edge 22*a* of the shade 22 is positioned further rearwards (rightwards in FIG. 1) than the rear focal point F. Because of this, as shown in FIG. 2, a gap G is defined between the arc-shaped front edge 22*a* of the shade 22 and a lens focal curve $F_L$ which is formed by connecting continuously the rear focal points F of the projection lens 12.

Because of this, in the vehicle lamp 10, not only light which passes in front of the rear focal point F of the projection lens 12 but also partial light which passes behind the rear focal point F of the projection lens 12, that is, light which passes between the front edge 22*a* and the rear focal point F (the lens focal curve $F_L$) contribute to the formation of the first light distribution pattern and the second light distribution pattern. The shade 22 has the front edge 22*a* which is shaped according to the light distribution patterns to be projected to the front.

As shown in FIG. 3, the shade 22 according to this embodiment is configured not only to form a low beam light distribution pattern PL having a first cut-off line CL1 by cutting off part of light emitted from the LED 14 but also to form a high beam light distribution pattern PH having a second cut-off line CL2 by cutting off part of light emitted from the LED 16. Additionally, as shown in FIG. 3, the low beam light distribution pattern PL and the high beam light distribution pattern PH overlap partially, and this restricts a non-illuminated area from being formed between the two light distribution patterns. The second cut-off line CL2 is formed at a lower end of the high beam light distribution pattern PH, and this prevents a near foreground area ahead of the vehicle from being illuminated brightly more than required, thereby making it possible to suppress the reduction in visibility.

Next, working effects resulting when the front edge 22*a* of the shade 22 is shifted from the rear focal point F will be described in detail. FIGS. 4(*a*) to 4(*h*) each illustrate a relationship between the position of a front end of the shade relative to the rear focal point F of the projection lens and light distribution patterns formed. FIGS. 4(*a*), 4(*c*), 4(*e*) and 4(*g*) show enlarged light distribution patterns which are formed in a central area R including a point of intersection between a line H-H and a line V-V shown in FIG. 3.

As shown in FIG. 4(*b*), the whole of the central area R is illuminated in case the shade 22 is not present. In a light distribution pattern PL1, a central area R2 including the line H-H is bright, and areas R1, R3 which lie above and below the central area R2 become darker than the area R2 (refer to FIG. 4(*a*)). In an actual light distribution pattern, an area lying near the line H-H becomes the brightest, and the brightness gradually decreases as the area expands upwards or downwards away from the line H-H. However, in this embodiment, the central area R is divided into areas R1, R2, and R3 as a matter of convenience in describing the function of the shade 22.

Next, as shown in FIG. 4(*d*), in case the front edge 22*a* of the shade 22 almost coincides in position with the rear focal point F, although almost a whole of a lower half of the central area R is illuminated, since the shade 22 has a certain thickness, a cut-off line CL3 at an upper end of a low beam light distribution pattern PL2 is formed slightly lower than the line H-H. In the low beam light distribution pattern PL2, an area R2 which lies below the line H-H becomes bright, and an area R3 which lies below the area R2 becomes darker than the area R2 (refer to FIG. 4(*c*)). Because of this, the cut-off line CL3 becomes relatively clear. In case the shade 22 is disposed as shown in FIG. 4(*d*), when a high beam light distribution pattern PH2 having a cut-off line CL4 at a lower end thereof is formed in addition to the low beam light distribution pattern PL2, there may be a situation in which a non-illuminated area R' is produced near the line H-H.

Then, as shown in FIG. 4(*f*), in case the front edge 22*a* of the shade 22 is positioned further rearwards than the rear focal point F (as shown in FIG. 1), not only light which passes in front of the rear focal point F of the projection lens 12 but also partial light which passes between the rear focal point F and the front edge 22*a* contribute to the formation of the light distribution patterns. Because of this, in a low beam light distribution pattern PL3, compared with the low beam light distribution pattern PL2 shown in FIG. 4(*c*), a cut-off line CL5 moves upwards. Similarly, in a high beam light distribution pattern PH3, compared with the high beam light distribution pattern PH2 shown in FIG. 4(*c*), a cut-off line CL6 moves downwards (refer to FIG. 4(*e*)). This enables the two light distribution patterns to overlap partially (refer to an area R"). This prevents the production of the non-illuminated area R' shown in FIG. 4(*c*) in an ensured fashion.

However, the cut-off line CL5 at the upper end of the low beam light distribution pattern PL3 lies away from the center (the line H-H), and therefore, the cut-off line CL5 becomes darker than the cut-off line CL3 which is shown lying near the center of the central area R in FIG. 4(*c*). Additionally, in case the lamp is tilted downwards so that the cut-off line CL5 approaches the center (the line H-H), there are fears that the near foreground area ahead of the vehicle becomes too bright. Then, to improve this point, as shown in FIG. 4(*h*), the front edge 22*a* of the shade 22 is disposed further rearwards and upwards than the rear focal point F of the projection lens 12.

Much of light of the light emitted from the low beam light source which is used to form an upper half of the light distribution pattern is cut off by disposing the shade 22 in the way described above, and therefore, in a low beam light distribution pattern PL4 shown in FIG. 4(*g*), a cut-off line CL7 is lowered to the vicinity of the center (the line H-H), compared with the low beam light distribution pattern PL3 shown in FIG. 4(*e*). In the low beam light distribution pattern PL4, similar to the area R2 shown in FIG. 4(*a*), an area lying near the line H-H is bright, and therefore, the cut-off line is formed in this area, whereby the cut-off line can be made clear.

On the other hand, by moving the shade 22 upwards, the quantity of light of the light emitted from the high beam light source which passes between the front edge 22*a* and the rear focal point F is increased, and a cut-off line CL8 of a high beam light distribution pattern PH4 is also lowered (refer to FIG. 4(*g*)). This can position a brightest area of the high beam light distribution pattern PH4 between the line H-H and the cut-off ling CL7 of the low beam light distribution pattern PL4.

The vehicle lamp 10 according this embodiment provides the following working effects in addition to those described above.

As shown in FIG. 3, the shade 22 according to this embodiment is configured to make the first cut-off line CL1 and the second cut-off line CL2 constitute a horizontal cut-off line from a center to areas lying near left and right end portions thereof. This enables light distribution patterns preferable for a motorbike, for example, to be obtained. The motorbike is caused to lean on many occasions while running, and therefore, vertically staggered light distribution patterns are not necessary on the motorbike so much as on a four-wheeled vehicle. Because of this, the light distribution patterns can be simplified, and hence, the shape of the shade 22 can be simplified.

As shown in FIG. 2, the shade 22 is disposed so that the front edge 22*a* thereof faces the focal curve of the projection lens 12 and is formed into a shape in which a distance G2 between the front edge 22*a* and the focal curve $F_L$ in an outer area which lies far away from the optical axis Ax is larger than a distance G1 between the front edge 22*a* and the focal curve $F_L$ in an area which lies near the optical axis Ax. This can change the shape of the cut-off line of the light distribution pattern which lies far away from the optical axis at both end portions thereof. Specifically, as shown in FIG. 3, cut-off lines CL1' of the first cut-off line CL1 of the low beam light distribution pattern PL which lie at both the end portions can be made to project to portions which lie above the line H-H. This can continue to illuminate the vicinity of the line H-H even though the cut-off line CL1' at one of the end portions of the low beam light distribution pattern PL is lowered in a direction indicated by an arrow A by causing a body of a motorbike on which the vehicle lamp 10 is mounted to lean to the left or right, whereby the forward visibility is made difficult to be reduced.

The vehicle lamp 10 includes the first reflector 18 which is configured to reflect light emitted from the LED 14 towards the projection lens 12 while directing it towards the optical axis Ax and the second reflector 20 which is provided on an opposite side to a side where the first reflector 18 is provided across the optical axis Ax and which is configured to reflect light emitted from the LED 16 towards the projection lens 12 while directing it towards the optical axis Ax. Additionally, the shade 22 is configured not only to form the low beam light distribution pattern PL having the first cut-off line CL1 at the upper edge portion but also to form the high beam light distribution pattern PH having the second cut-off line CL2 at the lower edge portion. This can form the different cut-off lines individually for the two light distribution patterns.

In addition, the shade 22 is configured to enable areas of the low beam light distribution pattern PL and the high beam light distribution pattern PH to partially overlap. The brightness at the illuminated area where the low beam light distribution pattern PL and the high beam light distribution pattern PH overlap can be improved by the shade 22 that is configured in the way described above.

Additionally, as shown in FIG. 1, the high beam light distribution pattern PH2 and the low beam light distribution pattern PL2 can be realized by the single projector lamp unit, and therefore, the whole of the vehicle lamp can be made small in size.

Second Embodiment

Figure 5:
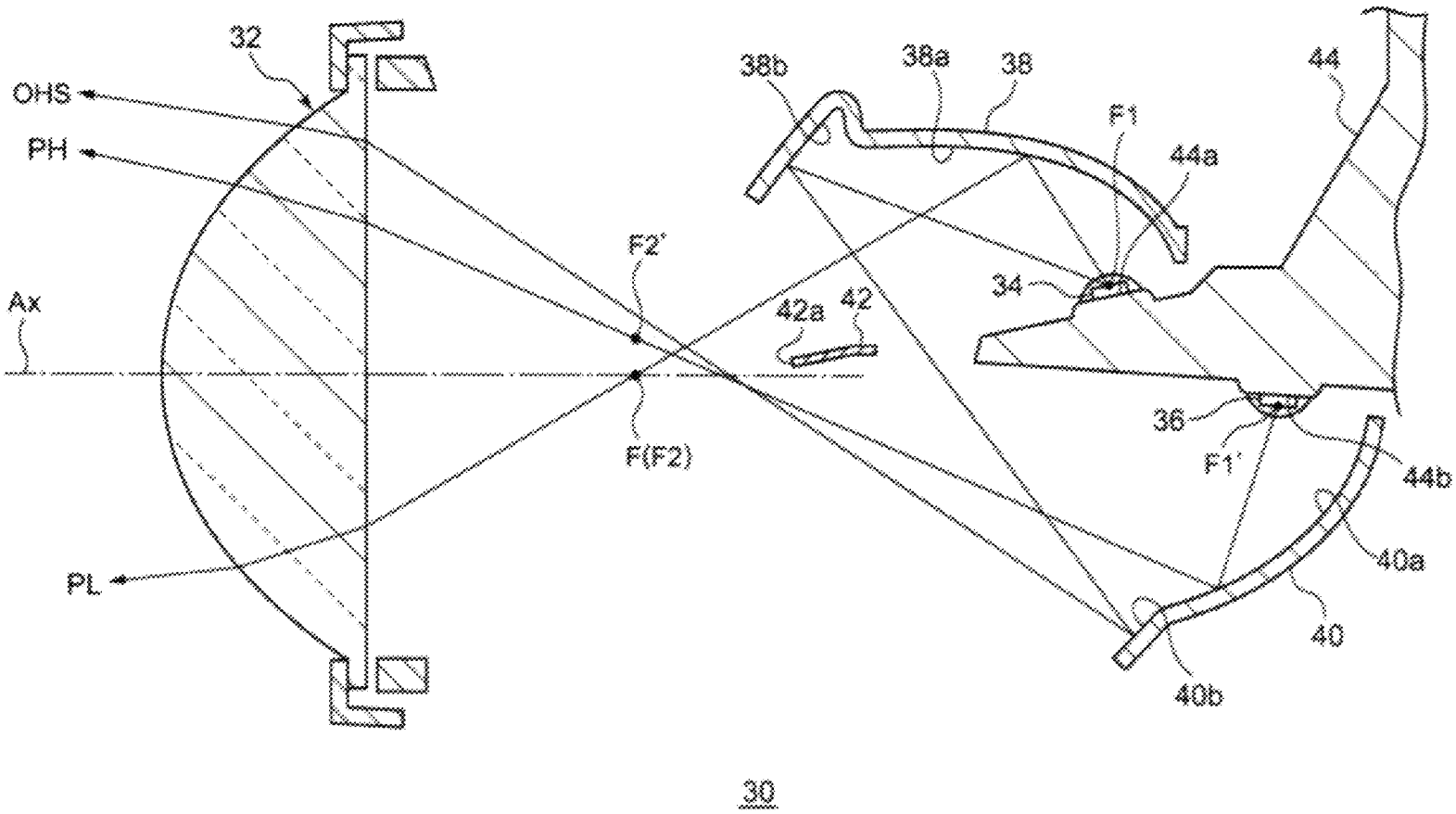
FIG. 5 is a vertical sectional view of a vehicle lamp according to a second embodiment, showing a brief configuration thereof.

FIG. 5 is a vertical sectional view of a vehicle lamp 30 according to a second embodiment, showing a brief configuration thereof. The vehicle lamp 30 is a vehicle headlamp in which light distribution patterns can be switched between a low beam light distribution pattern and a high beam light distribution pattern and an overhead sign can be formed when the low beam light distribution pattern or the high beam light distribution pattern is formed. The overhead sign means a light distribution pattern intended mainly to illuminate overhead signs and emits weak light which spreads on the order of 4 degrees vertically and on the order of 20 degrees horizontally.

The vehicle lamp 30 includes a projection lens 32 which is disposed on an optical axis Ax which extends in a longitudinal direction of a vehicle, LEDs (light emitting diodes) 34, 36 which constitute a first light source and a second light source, respectively, which are disposed to the rear of the projection lens 32, a first reflector 38 configured to reflect light emitted upwards from the LED 34 which is disposed further rearwards than a rear focal point F of the projection lens 32 towards the front while directing it towards the optical axis Ax, a second reflector 40 configured to reflect light emitted downwards from the LED 36 which is disposed further rearwards than the rear focal point F of the projection lens 32 towards the front while directing it towards the optical axis Ax, and a shade 42 which is disposed so that a front edge 42*a* is positioned in an area lying between the projection lens 32 and the LEDs 34, 36. The projection lens 32 and the LEDs 34, 36 have almost the same configurations as those of the first embodiment.

When mounted on a substrate, the LEDs 34, 36 are fixed to an upper surface and a lower surface of a base portion 44, respectively. The base portion 44 doubles as a heat sink, and a mounting portion 44*a* of the LED 34 and a mounting portion 44*b* of the LED 36 are provided apart from each other from the viewpoint of heat dissipation. Additionally, the mounting portion 44*b* of the LED 36 which is a light source for a high beam light distribution pattern is provided further rearwards than the mounting portion 44*a*. In this way, the mounting portions of the two light sources are spaded away from each other so as to enable efficient heat dissipation, and this arrangement also contributes to making the base portion 44 small in size.

The LED 34 emits light which is directed towards the rear focal point F of the projection lens 32, and the LED 36 emits light which is directed towards a second focal point F2' of the second reflector 40 which lies above the rear focal point F of the projection lens 32.

The LED 34 is illuminated not only to form a low beam light distribution pattern (PL) as a first light distribution pattern and an overhead sign (OHS) but also to form a high beam light distribution pattern (PH) as a second light distribution pattern. On the other hand, the LED 36 is illuminated to form the high beam light distribution pattern (PH).

The first reflector 38 has a reflecting surface 38*a* which is formed substantially ellipsoidal about the optical axis Ax as a center axis and a reflecting surface 38*b* which is formed further forwards towards a front end of the first reflector 38 than the reflecting surface 38*a* and which constitutes one of double reflecting surfaces for forming the overhead sign.

The reflecting surface 38*a* has a vertical section which is formed substantially by an ellipse. The LED 34 is disposed near a first focal point F1 of an ellipse which is formed by the vertical section of the reflecting surface 38*a* which includes the optical axis Ax. This allows the reflecting surface 38*a* to reflect light from the LED 34 to the front while directing it towards the optical axis Ax. As this occurs, the light is made to converge substantially to a second focal point F2 of the ellipse within the vertical section including the optical axis Ax. In this embodiment, the second focal point F2 coincides substantially with the focal point F of the projection lens 32. The reflecting surface 38*b* is configured to reflect part of light emitted from the LED 34 towards the second reflector 40.

The second reflector 40 has a reflecting surface 40*a* which is formed substantially ellipsoidal about the optical axis Ax as a center axis and a reflecting surface 40*b* which is formed further forwards towards a front end of the second reflector 40 than the reflecting surface 40*a* and which constitutes the other of the double reflecting surfaces for forming the overhead sign.

The reflecting surface 40*a* has a vertical section which is formed substantially by an ellipse which includes the optical axis Ax. The LED 36 is disposed near a first focal point F1' of an ellipse which is formed by the vertical section of the reflecting surface 40*a* which includes the optical axis Ax. This allows the reflecting surface 40*a* to reflect light from the LED 36 to the front while directing it towards the optical axis Ax. As this occurs, the light is made to converge substantially to a second focal point F2' of the ellipse within the vertical section including the optical axis Ax.

The second reflector 40 is disposed so that the second focal point F2' is positioned above the rear focal point F of the projection lens 32. A major axis of the second reflector 40 which has the ellipsoidal surface is inclined relative to the optical axis Ax. The reflecting surface 40*b* is configured to reflect the light emitted from the LED 34 and then reflected by the reflecting surface 38*b* towards the projection lens 32.

The shade 42 which forms the cut-off lines is a light cutting-off member which partially cuts off the light emitted from the LED 34 and then reflected on the reflecting surface 38*a* of the first reflector 38. The shade 42 is disposed so that a front edge 42*a* thereof is positioned further rearwards (rightwards in FIG. 5) and upwards than the rear focal point F. This produces a gap defined between the front edge 42*a* of the shade 42 and a lens focal curve which is formed by connecting continuously rear focal points F of the projection lens 32.

Because of this, in the vehicle lamp 30, not only light which passes in front of the rear focal point F of the projection lens 32 but also light which passes behind the rear focal point F of the projection lens 32, that is, light which passes between the front edge 42*a* and the rear focal point F contributes to the formation of the low beam light distribution pattern and the high beam light distribution pattern.

Consequently, similar to what is shown in FIG. 3, the vehicle lamp 30 of this embodiment is also configured not only to form a low beam light distribution pattern PL having a first cut-off line CL1 by cutting off part of light emitted from the LED 34 but also to form a high beam light distribution pattern PH having a second cut-off line CL2 by cutting off part of light emitted from the LED 36. In the vehicle lamp 30, similar to what is shown in FIG. 3, the low beam light distribution pattern PL and the high beam light distribution pattern PH overlap partially, and therefore, a non-illuminated area is restricted from being produced between the two light distribution patterns.

Additionally, in the vehicle lamp 30, the front edge 42*a* of the shade 42 is disposed further rearwards and upwards than the rear focal point F of the projection lens 32. This restricts the interference of light traveling from the reflecting surface 40*a* towards the second focal point F2' with the shade 42 even though the second reflector 40 is disposed so that the second focal point F2' of the second reflector 40 lies further upwards than the rear focal point F. Setting the second focal point F2' of the second reflector 40 so as to lie further upwards than the rear focal point F can move a position in the high beam light distribution pattern PH which has a largest luminous intensity further downwards than the line H-H. As has been described by reference to FIGS. 4(*g*) and 4(*h*), the cut-off line of the low bean light distribution pattern can be made clear.

In the vehicle lamp 30, the second reflector 40 which contributes to the formation of the high beam light distribution pattern lies further rearwards than the first reflector 38 which contributes to the formation of the low beam light distribution pattern. In this way, in case a distance between the first focal point F1' of the second reflector which has the ellipsoidal surface and the second focal point F2' thereof which lies near the rear focal point F becomes long, the ellipse itself which is defined by the two focal points becomes large, which increases the reflecting surface 40*a* of the second reflector 40, compared with a case where the distance is short. This enables much of the light emitted from the LED 36 to be reflected, and therefore, the largest luminous intensity in the high beam light distribution pattern can be increased.

In the vehicle lamp 30, in case a reflecting member (corresponding to the reflecting surface 40*b*) which is configured to reflect again the reflected light for overhead sign which is reflected on the reflecting surface 38*b* of the first reflector 38 is provided at the front edge 42*a* of the shade 42, this reflecting member interferes with part of the light reflected on the reflecting surface 40*a* of the second reflector 40 to form the high beam light distribution pattern, whereby a desired high beam light distribution pattern cannot be formed.

However, in the vehicle lamp 30 according to this embodiment, the reflecting surface 40*b* configured to reflect again the reflected light which is reflected on the reflecting surface 38*b* of the first reflector 38 to form the overhead sign is provided at the front end portion of the second reflector 40, and therefore, the problem of interference described above will never be caused.

Third Embodiment

Figure 6:
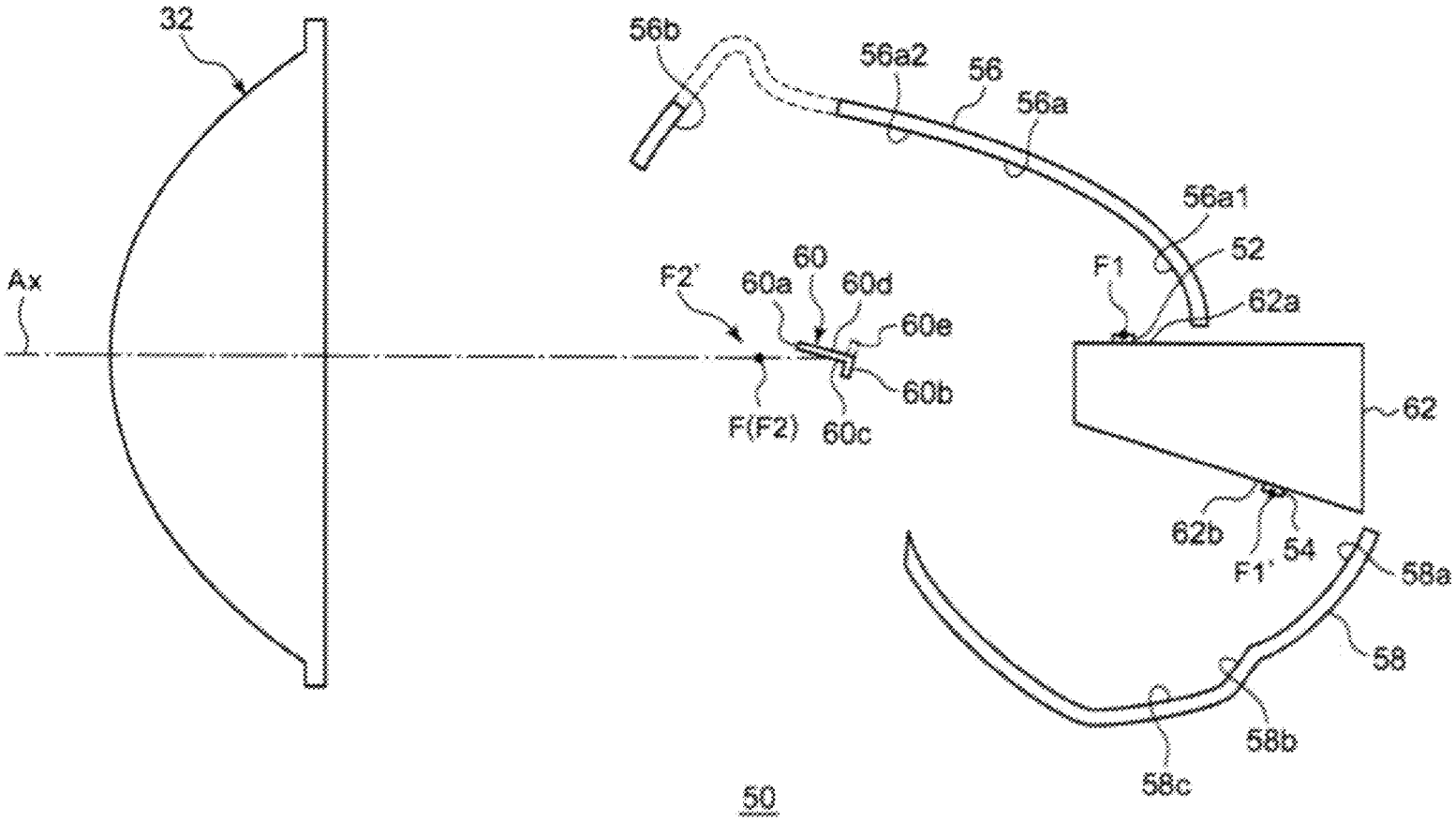
FIG. 6 is a vertical sectional view of a vehicle lamp according to a third embodiment, showing a brief configuration thereof.
Figure 7:
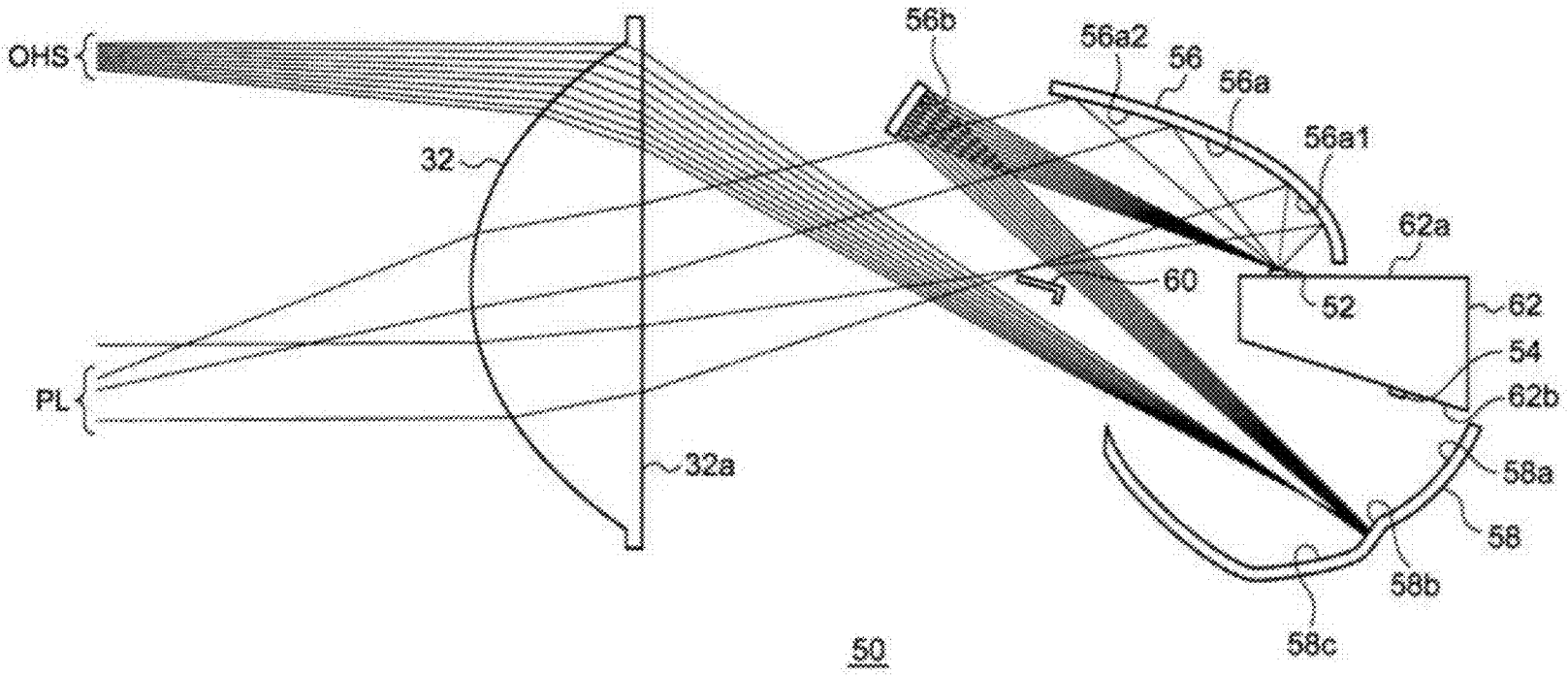
FIG. 7 is a light ray diagram resulting in such a state that the vehicle lamp forms a low beam light distribution pattern (PL) and an overhead sign (OHS).
Figure 8:
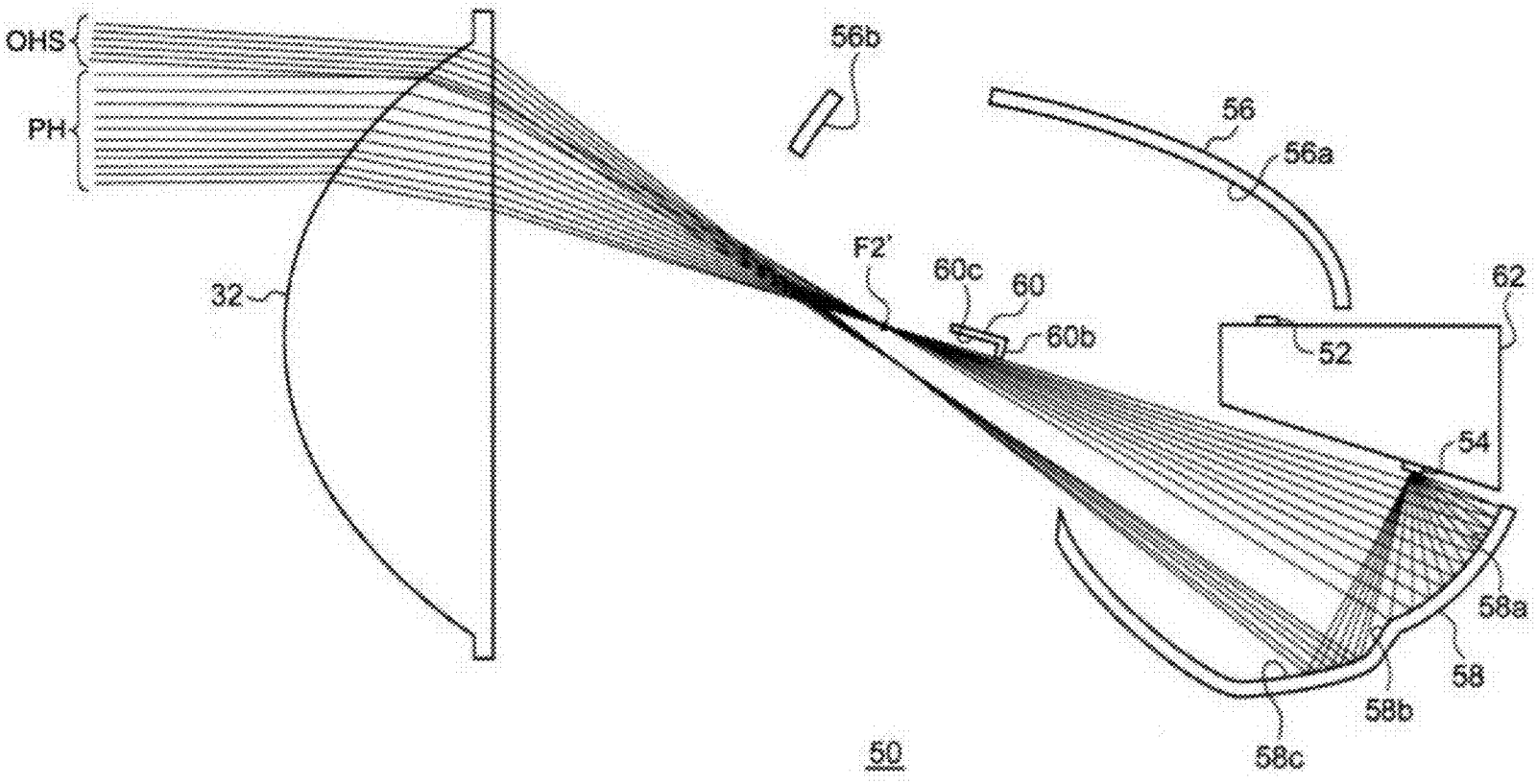
FIG. 8 is a light ray diagram resulting in such a state that the vehicle lamp forms a high beam light distribution pattern (PH).

FIG. 6 is a vertical sectional view of a vehicle lamp 50 according to a third embodiment, showing a brief configuration thereof. FIG. 7 is a light ray diagram resulting in such a state that the vehicle lamp 50 forms a low beam light distribution pattern (PL) and an overhead sign (OHS). FIG. 8 is a light ray diagram resulting in such a state that the vehicle lamp 50 forms a high beam light distribution pattern (PH) and an overhead sign (OHS).

Similar to the vehicle lamp 30 of the second embodiment, the vehicle lamp 50 is a vehicle headlamp in which light distribution patterns can be switched between a low beam light distribution pattern and a high beam light distribution pattern and an overhead sign can be formed when the low beam light distribution pattern or the high beam light distribution pattern is formed. In the following description, like reference numerals will be given to like configurations and working effects to those of vehicle lamp 30 of the second embodiment, and the repetition of similar descriptions thereof will be omitted as required.

The vehicle lamp 50 includes a projection lens 32 which is disposed on an optical axis Ax which extends in a longitudinal direction of a vehicle, LEDs (light emitting diodes) 52, 54 which constitute a first light source and a second light source, respectively, which are disposed to the rear of the projection lens 32, a first reflector 56 configured to reflect light emitted upwards from the LED 52 which is disposed further rearwards than a rear focal point F of the projection lens 32 towards the front while directing it towards the optical axis Ax, a second reflector 58 configured to reflect light emitted downwards from the LED 54 which is disposed further rearwards than the rear focal point F of the projection lens 32 towards the front while directing it towards the optical axis Ax, and a shade 60 which is disposed so that a front edge 60*a* is positioned in an area lying between the projection lens 32 and the LEDs 52, 54. The LEDs 52, 54 have almost the same configurations as those of the first embodiment and the second embodiment.

When mounted on a substrate, the LEDs 52, 54 are fixed to an upper surface and a lower surface of a base portion 62, respectively. The base portion 62 doubles as a heat sink, and a mounting portion 62*a* of the LED 52 and a mounting portion 62*b* of the LED 54 are provided apart from each other from the viewpoint of heat dissipation.

The LED 52 emits light which is directed towards the rear focal point F of the projection lens 32, and the LED 54 emits light which is directed towards a second focal point F2' of the second reflector 58 which lies above the rear focal point F of the projection lens 32.

The LED 52 is illuminated not only to form a low beam light distribution pattern (PL) as a first light distribution pattern and an overhead sign (OHS) (refer to FIG. 7) but also to form a high beam light distribution pattern (PH) as a second light distribution pattern. On the other hand, the LED 54 is illuminated to form the high beam light distribution pattern (PH) (refer to FIG. 8). As this occurs, the overhead sign (OHS) is also formed.

The first reflector 56 has a reflecting surface 56*a* which is formed by a free curved surface which is based on a substantially ellipsoidal shape formed about the optical axis Ax as a center axis and a reflecting surface 56*b* which is formed further forwards towards a front end of the first reflector 56 than the reflecting surface 56*a* and which constitutes one of double reflecting surfaces for forming the overhead sign.

A rear portion 56*a*1 of the reflecting surface 56*a* is so shaped as to reflect light emitted from the LED 52 to a downward portion in front of the lamp. A front portion 56*a*2 of the reflecting surface 56*a* continues to the rear portion 56*a*1 and is so shaped as to gradually spread as it extends towards the front of the lamp.

The LED 52 is disposed near a first focal point F1 (refer to FIG. 6) of an ellipse which is formed by a vertical section, including the optical axis Ax, of the rear portion 56*a*1 of the reflecting surface 56*a*. By being disposed in this way, when forming a low beam light distribution pattern shown in FIG. 7, the rear portion 56*a*1 of the reflecting surface 56*a* reflects light from the LED 52 to the front while directing it towards the optical axis Ax. As this occurs, the light is caused to converge substantially to a second focal point F2 (refer to FIG. 6) of the ellipse within the vertical section including the optical axis Ax. In this embodiment, this second focal point F2 substantially coincides with the rear focal point F (refer to FIG. 6) of the projection lens 32. The light reflected at the front portion 56*a*2 of the reflecting surface 56*a* is incident on the vicinity of a center of an incident surface 32*a* of the projection lens 32 as almost parallel light. The reflecting surface 56*b* is configured to reflect part of the light emitted from the LED 52 towards the second reflector 58.

The second reflector 58 has reflecting surfaces 58*a*, 58*c* which are formed into substantially ellipsoidal about the optical axis Ax as a center axis and a reflecting surface 58*b* which is formed further forwards towards a front end of the second reflector 58 than the reflecting surface 58*a* and which constitutes the other of the double reflecting surfaces for forming the overhead sign.

A sectional shape of the reflecting surface 58*a* which includes the optical axis Ax is formed substantially by an ellipse. The LED 54 is disposed near a first focal point F1' (refer to FIG. 6) of the ellipse which is formed by the vertical section of the reflecting surface 58*a* which includes the optical axis Ax. This allows the reflecting surface 58*a* to reflect light from the LED 54 to the front while directing it towards the optical axis Ax. As this occurs, the light is caused to converge substantially to the second focal point F2' (refer to FIG. 6) of the ellipse within the vertical section which includes the optical axis Ax.

The second reflector 58 is disposed so that the second focal point F2' lies above the rear focal point F of the projection lens 32 (refer to FIG. 6). A major axis of the second reflector 58 having the ellipsoidal surface is inclined relative to the optical axis Ax. The reflecting surface 58*b* is configured to reflect the light emitted from the LED 52 and then reflected on the reflecting surface 56*b* towards the projection lens 32.

Similarly, the reflecting surface 58*c* is configured to reflect the light emitted from the LED 54 towards the projection lens 32. The reflected light reflected on the reflecting surface 58*b* is used as light for forming the overhead sign. In this way, in the second reflector 58, the reflecting surface 58*a*, which reflects the light from the LED 54 to contribute to the formation of the high beam light distribution pattern PH, and the reflecting surface 58*b*, which reflects again the light emitted from the LED 52 and then reflected on the first reflector 56 to contribute to the formation of the overhead sign, are made integral with each other.

The shade 60 which forms cut-off lines is a light cutting-off member which cuts off part of the light emitted from the LED 52 and then reflected on the reflecting surface 56*a* of the first reflector 56. The shade 60 is disposed so that the front edge 60*a* lies further rearwards (rightwards in FIG. 6) and upwards than the rear focal point F.

Because of this, the vehicle lamp 50 provides the same working effects as those provided by the vehicle lamps according to the embodiments which have been described before.

In the vehicle lamp 50 according to the third embodiment, the mounting portion 62*a* of the base portion 62 on which the LED 52 which mainly forms the low beam light distribution pattern is almost parallel to the optical axis of the projection lens 32. This allows the lights which form the low beam light distribution pattern PL to pass through the projection lens 32 near the center thereof as shown in FIG. 7, and therefore, compared with a case where the lights pass through the projection lens 32 at a circumferential area thereof (for example, the low beam light distribution pattern PL of FIG. 5), the color separation is reduced, whereby it is possible to restrict a cut-off line formed from becoming bluish. An angle formed by the mounting portion 62*b* on which the LED 54 is mounted and the mounting portion 62*a* is of the order of 15 to 16 degrees.

The shade 60 of the vehicle lamp 50 has a bent portion 60*b* which is formed by bending a rear end thereof downwards. This can increase the strength of the shade 60. In addition, this can prevent the light reflected on the reflecting surface 58*a* of the second reflector 58 from being reflected on a lower surface 60*c* of the shade 60, otherwise the reflected light becoming stray light. Additionally, the shade 60 is lowered more at the rear end (the bent portion 60*b*) than at the front edge 60*a*, whereby even though the light emitted from the LED 52 and then reflected on the first reflector 56 is reflected on an upper surface 60*d* of the shade 60, the reflected light can be made not to be incident on the projection lens 32. In this way, the light reflected again by the shade 60 is prevented from being incident on the projection lens 32, whereby the generation of a boundary between bright and dark areas in one light distribution pattern can be restricted, thereby making it possible to improve the driver's visibility of the illuminated area ahead of the vehicle.

The shade 60 may have a bent portion 60*e* which is formed by bending the rear end upwards. As this occurs, the light which is reflected at the rear portion 56*a*1 of the first reflector 56 to be incident on the upper surface 60*d* of the shade 60 at an angle close to the horizontal can be cut off, whereby the light which is reflected again on the upper surface 60*d* of the shade 60 can be prevented from being incident on the projection lens 32.

From the viewpoint of realizing the vehicle lamp in which the two light distribution patterns partially overlap, there will be no problem in case the light reflected again on the lower surface 60*c* or the upper surface 60*d* of the shade 60 is allowed to be incident on the projection lens 32 to improve the brightness.

Thus, while the invention has been described by reference to the embodiments, the invention is not limited by the embodiments, and hence, appropriate combinations or replacements of the configurations of the embodiments are also included in the invention. Additionally, those skilled in the art can change the combinations of the configurations or the order of the processes as required in the embodiments or make various design changes to the embodiments based on the common knowledge thereof. Embodiments to which those modifications are made are also included in the scope of the invention.

The invention claimed is:

1. A vehicle lamp comprising:

a projection lens which is disposed on an optical axis which extends in a longitudinal direction of a vehicle;

a first light source which emits light which is directed towards a rear focal point of the projection lens;

a second light source which emits light which is directed towards the rear focal point of the projection lens; and a shade which can not only form a first light distribution pattern having a first cut-off line by cutting off part of light emitted from the first light source but also form a second light distribution pattern having a second cut-off line by cutting off part of light emitted from the second light source, wherein the shade is disposed so that a front end portion thereof is positioned further rearwards than the rear focal point, wherein the shade is disposed so that the front end portion thereof faces a focal curve of the projection lens, and wherein the shade is formed into a shape in which a distance between the front end portion and the focal curve in an area which lies far away from the optical axis is larger than a distance between the front end portion and the focal curve in an area which lies near the optical axis.

2. The vehicle lamp according to claim 1, wherein the shade is configured to make the first cut-off line and the second cut-off line constitute a horizontal cut-off line from a center to areas lying near left and right end portions thereof.

3. The vehicle lamp according to claim 1, comprising further:

a first reflector configured to reflect light emitted from the first light source towards the projection lens while directing it towards the optical axis; and a second reflector which is provided on an opposite side to a side where the first reflector is provided across the optical axis and which is configured to reflect light emitted from the second light source towards the projection lens while directing it towards the optical axis, wherein the shade is configured not only to form a low beam light distribution pattern having a first cut-off line at an upper edge portion but also to form a high beam light distribution pattern having a second cut-off line at a lower edge portion.

4. The vehicle lamp according to claim 1, wherein the shade is configured to enable areas of the first light distribution pattern and the second light distribution pattern to partially overlap.

* * * * *